US010578309B2

(12) United States Patent
Green

(10) Patent No.: US 10,578,309 B2
(45) Date of Patent: Mar. 3, 2020

(54) COOKTOP APPLIANCE WITH A GAS BURNER

(71) Applicant: Haier US Appliance Solutions, Inc., Wilmington, DE (US)

(72) Inventor: Jeremy Michael Green, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 130 days.

(21) Appl. No.: 15/859,813

(22) Filed: Jan. 2, 2018

(65) Prior Publication Data

US 2019/0203942 A1 Jul. 4, 2019

(51) Int. Cl.

| | |
|---|---|
| ***F23N 5/02*** | (2006.01) |
| ***F24C 3/12*** | (2006.01) |
| ***F23N 1/00*** | (2006.01) |

(52) U.S. Cl.

CPC ..... *F24C 3/124* (2013.01); *F23N 1/002* (2013.01); *F23N 5/022* (2013.01); *F24C 3/126* (2013.01); *F23N 2035/12* (2013.01); *F23N 2039/04* (2013.01); *F23N 2041/08* (2013.01)

(58) Field of Classification Search

CPC ..... F23N 1/002

USPC ..... 126/39 E

See application file for complete search history.

(56) References Cited

U.S. PATENT DOCUMENTS

| | | | | |
|---|---|---|---|---|
| 5,746,114 | A | 5/1998 | Harris | |
| 8,479,721 | B2 | 7/2013 | Graham et al. | |
| 2002/0175213 | A1* | 11/2002 | Wodeslavsky | F24C 3/126 236/20 A |
| 2006/0057520 | A1* | 3/2006 | Saia | F23N 1/005 431/281 |

FOREIGN PATENT DOCUMENTS

| | | | |
|---|---|---|---|
| CN | 104697008 | A | 6/2015 |
| CN | 206222379 | U | 6/2017 |

* cited by examiner

*Primary Examiner* — Avinash A Savani

(74) *Attorney, Agent, or Firm* — Dority & Manning, P.A.

(57) ABSTRACT

A cooktop appliance includes a gas burner. A primary control valve is coupled to the gas burner. The primary control valve is manually adjustable to regulate a flow of gaseous fuel to the gas burner. A secondary control valve is connected in series between the primary control valve and the gas burner. A controller is in communication with the secondary control valve. The controller is configured to receive a temperature measurement from a temperature sensor and to adjust the secondary control valve in response to the temperature measurement from the temperature sensor.

15 Claims, 3 Drawing Sheets

COOKTOP APPLIANCE WITH A GAS BURNER

FIELD OF THE INVENTION

The present subject matter relates generally to cooktop appliances with gas burner assemblies, such as gas range appliances or gas stove appliances.

BACKGROUND OF THE INVENTION

Certain cooktop appliances include gas burners for heating cooking utensils on the cooktop appliances. Some users prefer gas burners over electric heating elements due to the adjustability of gas burners. In particular, a gas burner's control valve can provide more heat outputs comparted to the discrete number of output settings available for electric heating elements. However, precisely heating a cooking utensil with a gas burner can be difficult. For example, a user may have to constantly monitor the cooking utensil and tweak the control valve to maintain a particular temperature in the cooking utensil, and such monitoring and adjustment can be tedious.

Accordingly, a cooktop appliance with features for operating a gas burner to maintain a particular temperature in a cooking utensil would be useful.

BRIEF DESCRIPTION OF THE INVENTION

The present subject matter provides a cooktop appliance with a gas burner. A primary control valve is coupled to the gas burner. The primary control valve is manually adjustable to regulate a flow of gaseous fuel to the gas burner. A secondary control valve is connected in series between the primary control valve and the gas burner. A controller is in communication with the secondary control valve. The controller is configured to receive a temperature measurement from a temperature sensor and to adjust the secondary control valve in response to the temperature measurement from the temperature sensor. Additional aspects and advantages of the invention will be set forth in part in the following description, or may be apparent from the description, or may be learned through practice of the invention.

In a first example embodiment, a cooktop appliance includes a gas burner. A temperature sensor is separate from the gas burner. The temperature sensor is configured to measure a temperature at a utensil heated by the gas burner. A primary control valve is coupled to the gas burner. The primary control valve is manually adjustable to regulate a flow of gaseous fuel to the gas burner. A secondary control valve is connected in series between the primary control valve and the gas burner. A controller is in communication with the temperature sensor and the secondary control valve. The controller is configured to receive a temperature measurement from the temperature sensor and to adjust the secondary control valve in response to the temperature measurement from the temperature sensor.

In a second example embodiment, a cooktop appliance includes a gas burner. A primary control valve is coupled to the gas burner. The primary control valve is manually adjustable to regulate a flow of gaseous fuel to the gas burner. A secondary control valve is connected in series between the primary control valve and the gas burner. A controller is in communication with the secondary control valve. The controller is configured to receive a temperature measurement from a temperature sensor configured to measure a temperature at a utensil heated by the gas burner and to adjust the secondary control valve in response to the temperature measurement from the temperature sensor.

In a third example embodiment, a method for closed loop control of a cooktop appliance includes manually opening a primary control valve coupled to a gas burner in order to initiate a flow of gaseous fuel to the gas burner, measuring a temperature of at a utensil heated by the gas burner with a temperature sensor, and adjusting the flow of gaseous fuel to the gas burner with a secondary control valve in response to the temperature measurement from the temperature sensor. The secondary control valve is connected in series between the primary control valve and the gas burner.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
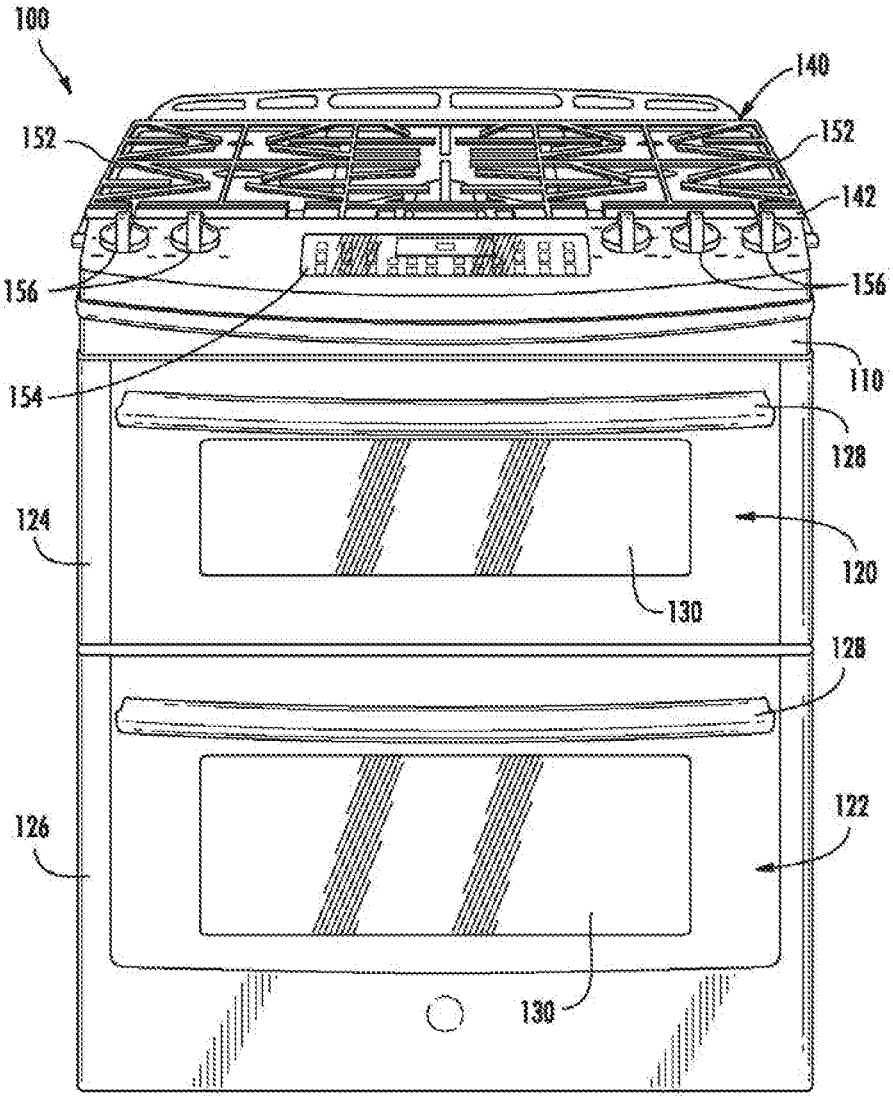
FIG. 1 provides a front, perspective view of a range appliance according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
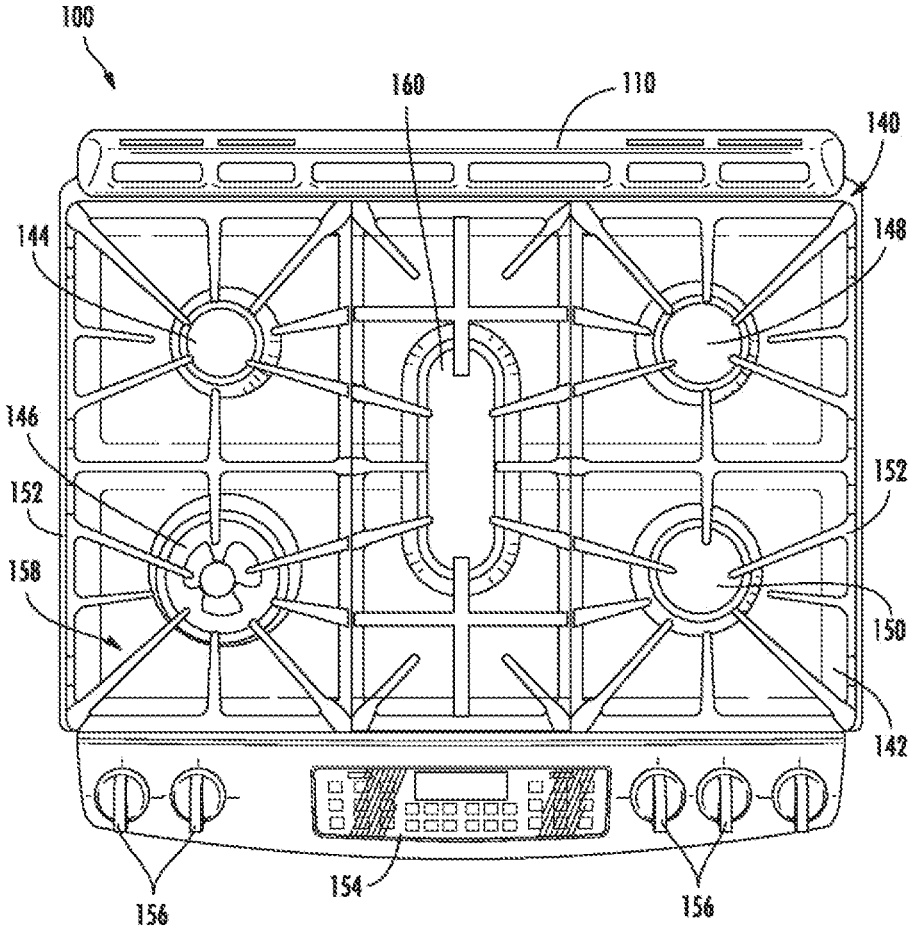
FIG. 2 provides a top, plan view of the example range appliance of FIG. 1.

FIG. 1 provides a front, perspective view of a range appliance 100 as may be employed with the present subject matter. FIG. 2 provides a top, plan view of range appliance 100. Range appliance 100 includes an insulated cabinet 110. Cabinet 110 defines an upper cooking chamber 120 and a lower cooking chamber 122. Thus, range appliance 100 is generally referred to as a double oven range appliance. As will be understood by those skilled in the art, range appliance 100 is provided by way of example only, and the present subject matter may be used in any suitable appliance, e.g., a single oven range appliance or a standalone cooktop appliance. Thus, the example embodiment shown in FIG. 1 is not intended to limit the present subject matter to any particular cooking chamber configuration or arrangement.

Upper and lower cooking chambers 120 and 122 are configured for the receipt of one or more food items to be cooked. Range appliance 100 includes an upper door 124 and a lower door 126 rotatably attached to cabinet 110 in order to permit selective access to upper cooking chamber 120 and lower cooking chamber 122, respectively. Handles 128 are mounted to upper and lower doors 124 and 126 to assist a user with opening and closing doors 124 and 126 in order to access cooking chambers 120 and 122. As an example, a user can pull on handle 128 mounted to upper door 124 to open or close upper door 124 and access upper cooking chamber 120. Glass window panes 130 provide for viewing the contents of upper and lower cooking chambers 120 and 122 when doors 124 and 126 are closed and also assist with insulating upper and lower cooking chambers 120 and 122. Heating elements (not shown), such as electric resistance heating elements, gas burners, microwave heating elements, halogen heating elements, or suitable combinations thereof, are positioned within upper cooking chamber 120 and lower cooking chamber 122 for heating upper cooking chamber 120 and lower cooking chamber 122.

Range appliance 100 also includes a cooktop 140. Cooktop 140 is positioned at or adjacent a top portion of cabinet 110. Thus, cooktop 140 is positioned above upper and lower cooking chambers 120 and 122. Cooktop 140 includes a top panel 142. By way of example, top panel 142 may be constructed of glass, ceramics, enameled steel, and combinations thereof.

For range appliance 100, a utensil holding food and/or cooking liquids (e.g., oil, water, etc.) may be placed onto grates 152 at a location of any of burner assemblies 144, 146, 148, 150. Burner assemblies 144, 146, 148, 150 provide thermal energy to cooking utensils on grates 152. As shown in FIG. 1, burners assemblies 144, 146, 148, 150 can be configured in various sizes so as to provide e.g., for the receipt of cooking utensils (i.e., pots, pans, etc.) of various sizes and configurations and to provide different heat inputs for such cooking utensils. Grates 152 are supported on a top surface 158 of top panel 142. Range appliance 100 also includes a griddle burner 160 positioned at a middle portion of top panel 142, as may be seen in FIG. 2. A griddle may be positioned on grates 152 and heated with griddle burner 160.

A user interface panel 154 is located within convenient reach of a user of the range appliance 100. For this example embodiment, user interface panel 154 includes knobs 156 that are each associated with one of burner assemblies 144, 146, 148, 150 and griddle burner 160. Knobs 156 allow the user to activate each burner assembly and determine the amount of heat input provided by each burner assembly 144, 146, 148, 150 and griddle burner 160 to a cooking utensil located thereon. User interface panel 154 may also be provided with one or more graphical display devices that deliver certain information to the user such as e.g., whether a particular burner assembly is activated and/or the rate at which the burner assembly is set.

Although shown with knobs 156, it should be understood that knobs 156 and the configuration of range appliance 100 shown in FIG. 1 is provided by way of example only. More specifically, user interface panel 154 may include various input components, such as one or more of a variety of touch-type controls, electrical, mechanical or electro-mechanical input devices including rotary dials, push buttons, and touch pads. The user interface panel 154 may include other display components, such as a digital or analog display device designed to provide operational feedback to a user.

Figure 3:
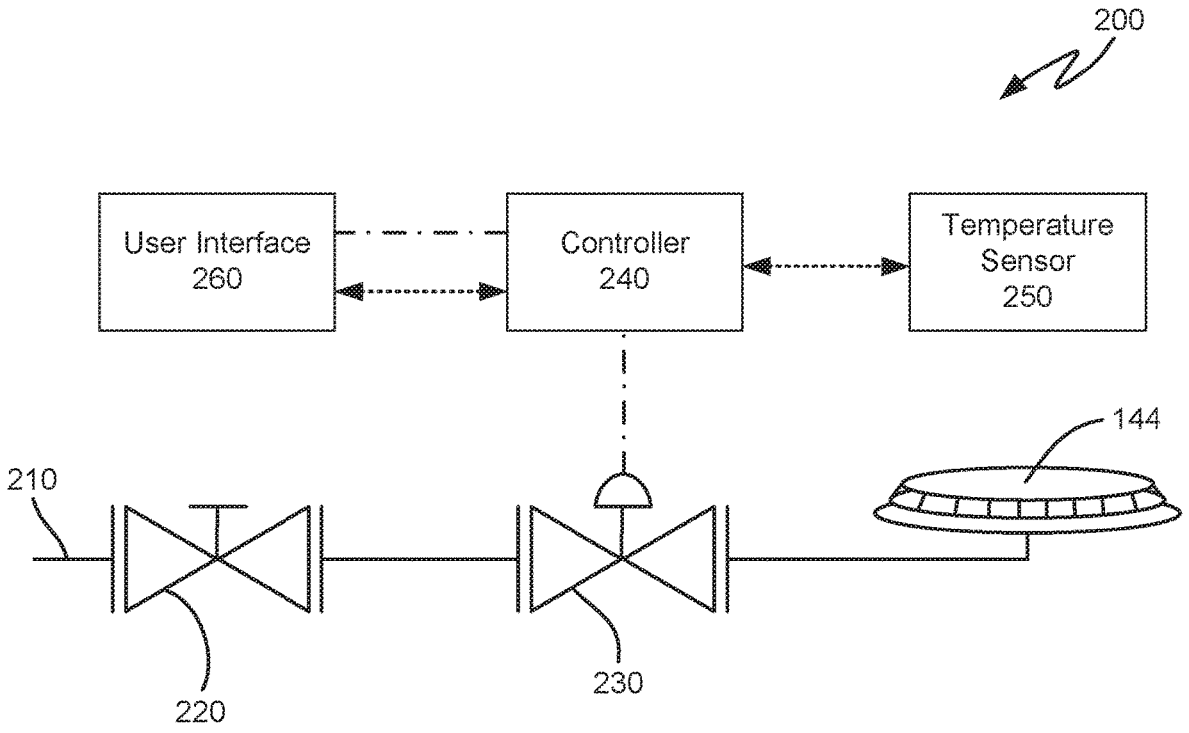
FIG. 3 is a schematic view of certain components of the example range appliance of FIG. 1.

FIG. 3 is a schematic view of certain components of range appliance 100. In particular, as shown in FIG. 3, range appliance 100 includes a fuel supply system 200. Fuel supply system 200 includes a supply line 210, a primary control valve 220 and a secondary control valve 230. Supply line 210 may be a metal tube, such copper or aluminum tubing, that is connectable to a fuel supply. Thus, supply line 210 may receive a flow of pressurized gaseous fuel, e.g., natural gas or propane, from the fuel supply. Supply line 210 also extends to burner assembly 144 within cabinet 110 below top panel 142. Thus, the gaseous fuel may flow from the fuel supply to burner assembly 144 through supply line 210. Although not shown in FIG. 3, the other burner assemblies 146, 148, 150 may be connected to supply line 210 in a similar manner. In particular, each one of burner assemblies 146, 148, 150 may have a respective primary control valve 220 and secondary control valve 230, in certain example embodiments.

Primary control valve 220 is coupled to supply line 210 and is configured for regulating the flow of gaseous fuel through supply line 210 to burner assembly 144. In particular, primary control valve 220 may be coupled to one of knobs 156 such that primary control valve 220 is manually adjustable to regulate the flow of gaseous fuel to burner assembly 144. For example, a user may rotate the knob 156 coupled to primary control valve 220 to a "HI" setting in order to maximize the flow of gaseous fuel to burner assembly 144, and the user may rotate the knob 156 coupled to primary control valve 220 to a "LO" setting in order to minimize the flow of gaseous fuel to burner assembly 144. In addition, the user may rotate the knob to a setting between the "HI" and "LO" settings to adjust the flow of gaseous fuel to burner assembly 144 between the maximum and minimum flows, or the user may rotate the knob 156 coupled to primary control valve 220 to a "OFF" setting in order to terminate the flow of gaseous fuel to burner assembly 144. Thus, it will be understood that primary control valve 220 may be a standard manual surface burner valve, in certain example embodiments.

Secondary control valve 230 is also coupled to supply line 210. However, secondary control valve 230 is connected in series between primary control valve 220 and burner assembly 144. Thus, secondary control valve 230 may be positioned downstream of primary control valve 220 on supply line 210 relative to the flow of fuel from the fuel source. In such a manner, secondary control valve 230 may further regulate the flow of gaseous fuel to burner assembly 144 after primary control valve 220. In particular, secondary control valve 230 may be operable in a closed loop control system to regulate gaseous fuel flow to burner assembly 144, as discussed in greater detail below. Secondary control valve 230 may be a normally open valve, e.g., such that secondary control valve 230 does not interfere with gaseous fuel flow to burner assembly 144 unless the closed loop control system is activated. Thus, primary control valve 220 alone may control gaseous fuel flow to burner assembly 144 when the closed loop control system is deactivated. In alternative example embodiments, secondary control valve 230 may be a normally closed valve.

Secondary control valve 230 may be an electronic pressure regulating valve, a motorized valve, a modulating valve, a solenoid valve, or some other variable type gas flow valve. Thus, secondary control valve 230 may be automatically adjusted to regulate the flow of gaseous fuel to burner assembly 144, e.g., rather than being manually actuated as with primary control valve 220. In particular, range appliance 100 includes a controller 240 that regulates various components of range appliance 100. Controller 240 is in operative communication with various components of range appliance 100, such secondary control valve 230 and/or a temperature sensor 250. Thus, controller 240 may adjust secondary control valve 230 in order to regulate the flow of gaseous fuel to burner assembly 144.

Controller 240 includes memory and one or more processing devices such as microprocessors, CPUs or the like, such as general or special purpose microprocessors operable to execute programming instructions or micro-control code associated with operation of range appliance 100. The memory can be non-transitory and represent random access memory such as DRAM, or read only memory such as ROM or FLASH. The processor executes programming instructions stored in the memory. The memory can be a separate component from the processor or can be included onboard within the processor. Alternatively, controller 240 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 240 is also in communication with temperature sensor 250. Temperature sensor 250 is separate from burner assembly 144, and temperature sensor 250 is configured to measure a temperature at a utensil heated by burner assembly 144. Thus, temperature sensor 250 may be a thermistor or thermocouple positioned on and/or disposed within a utensil positioned above burner assembly 144 on cooktop 140. Controller 240 receives temperature measurements from temperature sensor 250. For example, controller 240 and temperature sensor 250 may each include a wireless transmitter/receiver such that controller 240 and temperature sensor 250 communicate with each other wirelessly, e.g., via a Bluetooth® or Wi-Fi connection. In certain example embodiments, temperature sensor 250 is a separate component mountable to the utensil heated by burner assembly 144. In alternative example embodiments, temperature sensor 250 may be integrated within the utensil heated by burner assembly 144.

Utilizing temperature measurements from temperature sensor 250, controller 240 may adjust secondary control valve 230 and regulate the flow of gaseous fuel to burner assembly 144. For example, a user may open primary control valve 220 to initiate gaseous fuel flow to burner assembly 144 and light burner assembly 144. In particular, the user may open primary control valve 220 to the "HI" setting in order to maximize the span of regulated gaseous fuel provided by secondary control valve 230. The user may also turn on the closed loop control system to activate secondary control valve 230.

When the closed loop control system is activated, controller 240 receives the temperature measurements from temperature sensor 250 and compares the temperature measurements to a set temperature. In order to reduce a difference between the temperature measurements from temperature sensor 250 and the set temperature, controller 240 adjusts the flow of gaseous fuel to burner assembly 144 with secondary control valve 230. In particular, controller 240 may adjust secondary control valve 230 to decrease the flow of gaseous fuel to burner assembly 144 when the temperature measurements from temperature sensor 250 are greater than the set temperature. Conversely, controller 240 may adjust secondary control valve 230 to increase the flow of gaseous fuel to burner assembly 144 when the temperature measurements from temperature sensor 250 are less than the set temperature. Thus, the heat output provided by burner assembly 144 may be regulated by the closed loop control system, e.g., without additional user input and/or monitoring.

A user may establish the set temperature via a user interface 260. Controller 240 is in communication with user interface 260 and is configured to receive the user-determined set temperature from user interface 260. User interface 260 may correspond to user interface panel 154 in certain example embodiments. Thus, the user may utilize keys on user interface panel 154 to establish the set temperature. In such example embodiments, user interface 260 is positioned on top panel 142 and may be in communication with controller 240 via a wiring harness. As another example, user interface 260 may correspond to an application on a smartphone or other device, and the user may utilize the application to establish the set temperature. In such example embodiments, user interface 260 may be in wireless communication with controller 240, e.g., via a Bluetooth® or Wi-Fi connection.

As may be seen from the above, fuel supply system 200 provides a low cost closed loop gas surface burner control. Adding secondary control valve 230 in series with primary control valve 220 allows controller 240 to adjust gaseous fuel flow to burner assembly 144 in response to temperatures measurements from temperature sensor 250. In such a manner, the temperature of the utensil heated by burner assembly 144 can be precisely controlled without constant monitoring by the user of range appliance 100. Utilizing a tradition knob actuated primary control valve 220 may preserve the traditional lighting of burner assembly 144 and the normal operation of burner assembly 144 when the closed loop burner control is not in use. It will be understood that while described in the context of one gas burner, fuel supply system 200 may also be used to control multiple gas burners in alternative example embodiments.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance, comprising:

a gas burner;

a temperature sensor separate from the gas burner, the temperature sensor configured to measure a temperature at a utensil heated by the gas burner;

a primary control valve coupled to the gas burner, the primary control valve manually adjustable to regulate a flow of gaseous fuel to the gas burner;

a secondary control valve connected in series between the primary control valve and the gas burner;

a user interface;

a controller in communication with the user interface, the temperature sensor, and the secondary control valve, the controller configured to receive a user-determined set temperature from the user interface, receive a temperature measurement from the temperature sensor, and adjust the secondary control valve in response to the temperature measurement from the temperature sensor.

2. The cooktop appliance of claim 1, wherein a difference between the user-determined set temperature and the temperature measurement from the temperature sensor is reduced when the controller adjusts the secondary control valve in response to the temperature measurement from the temperature sensor.

3. The cooktop appliance of claim 1, wherein the user interface is positioned on a top panel with the gas burner.

4. The cooktop appliance of claim 1, wherein the user interface is wirelessly connected to the controller.

5. The cooktop appliance of claim 1, wherein the secondary control valve is an electronic pressure regulating valve, a motorized valve, a modulating valve or a solenoid valve.

6. The cooktop appliance of claim 1, wherein the temperature sensor is wirelessly connected to the controller.

7. A cooktop appliance, comprising:

a gas burner;

a primary control valve coupled to the gas burner, the primary control valve manually adjustable to regulate a flow of gaseous fuel to the gas burner;

a secondary control valve connected in series between the primary control valve and the gas burner; and a controller in communication with the secondary control valve, the controller configured to receive a temperature measurement from a temperature sensor configured to measure a temperature at a utensil heated by the gas burner, and adjust the secondary control valve in response to the temperature measurement from the temperature sensor, wherein the secondary control valve is an electronic pressure regulating valve, a motorized valve, a modulating valve, or a solenoid valve.

8. The cooktop appliance of claim 7, further comprising a user interface, the controller in communication with the user interface, the controller configured to receive a user-determined set temperature from the user interface.

9. The cooktop appliance of claim 8, wherein a difference between the user-determined set temperature and the temperature measurement from the temperature sensor is reduced when the controller adjusts the secondary control valve in response to the temperature measurement from the temperature sensor.

10. The cooktop appliance of claim 8, wherein the user interface is positioned on a top panel with the gas burner.

11. The cooktop appliance of claim 8, wherein the user interface is wirelessly connected to the controller.

12. A method for closed loop control of a cooktop appliance, comprising:

manually opening a primary control valve coupled to a gas burner in order to initiate a flow of gaseous fuel to the gas burner;

measuring a temperature of at a utensil heated by the gas burner with a temperature sensor; and adjusting the flow of gaseous fuel to the gas burner with a secondary control valve in response to the temperature measurement from the temperature sensor, the secondary control valve connected in series between the primary control valve and the gas burner, wherein the temperature sensor is wirelessly connected to the controller.

13. The method of claim 12, further comprising receiving a user-determined set temperature from a user interface.

14. The method of claim 13, wherein a difference between the user-determined set temperature and the temperature measurement from the temperature sensor is reduced during said step of adjusting.

15. The method of claim 12, wherein the secondary control valve is an electronic pressure regulating valve, a motorized valve, a modulating valve or a solenoid valve.

* * * * *